US008443767B2

(12) United States Patent
Murphy et al.

(10) Patent No.: US 8,443,767 B2
(45) Date of Patent: May 21, 2013

(54) AIR VENTING ARRANGEMENT

(75) Inventors: Adam P. Murphy, Chilicothe, IL (US); Patrice L. Cummings, Raleigh, NC (US); Kyle C. Hummel, Bloomington, IN (US); Mark D. Ross, Six Mile, SC (US)

(73) Assignee: Caterpillar Inc., Peoria, IL (US)

( * ) Notice: Subject to any disclaimer, the term of this patent is extended or adjusted under 35 U.S.C. 154(b) by 677 days.

(21) Appl. No.: 12/725,489

(22) Filed: Mar. 17, 2010

(65) Prior Publication Data

US 2010/0242867 A1 Sep. 30, 2010

Related U.S. Application Data

(60) Provisional application No. 61/163,962, filed on Mar. 27, 2009.

(51) Int. Cl.
*F01P 3/22* (2006.01)

(52) U.S. Cl.
USPC ..... 123/41.54; 220/201; 220/202; 220/203

(58) Field of Classification Search ..... 123/41.54; 220/201–203
See application file for complete search history.

(56) References Cited

U.S. PATENT DOCUMENTS

| | | | | |
|---|---|---|---|---|
| 1,217,732 | A * | 2/1917 | Fedders | 165/148 |
| 1,378,070 | A | 5/1921 | Welge | |
| 1,906,072 | A | 4/1933 | Lumsden | |
| 3,576,181 | A | 4/1971 | Neal et al. | |
| 3,939,901 | A | 2/1976 | Cieszko et al. | |
| 4,064,848 | A * | 12/1977 | Pabst et al. | 123/41.54 |
| 4,231,424 | A | 11/1980 | Moranne | |
| 4,592,418 | A | 6/1986 | Cadars | |
| 4,643,134 | A | 2/1987 | Schnizlein | |
| 5,044,430 | A | 9/1991 | Avrea | |
| 5,456,218 | A * | 10/1995 | Theorell | 123/41.54 |
| 5,666,911 | A | 9/1997 | Gohl et al. | |
| 6,109,310 | A | 8/2000 | Peotter | |
| 7,152,639 | B2 | 12/2006 | Aschoff et al. | |
| 7,261,069 | B2 | 8/2007 | Gunther | |
| 2005/0151798 | A1 | 7/2005 | Merz et al. | |

FOREIGN PATENT DOCUMENTS

EP 0186375 A1 7/1986

* cited by examiner

*Primary Examiner* — Marguerite McMahon
*Assistant Examiner* — James Kim
(74) *Attorney, Agent, or Firm* — Leydig, Voit & Mayer

(57) ABSTRACT

An air venting arrangement for a liquid cooling system associated with an internal combustion engine has a shunt vessel, and a transfer conduit connecting a flange portion of the shunt vessel to the liquid cooling system, and configured to pass coolant between the shunt vessel and the liquid cooling system. A venting conduit is disposed in a bore of the flange portion, and positioned to vent entrained air in the transfer conduit, developed during a filling of the cooling system, to a portion of the shunt vessel, and reduce the time required in filling of the liquid cooling system. A compression limiter and fastener connected to the compression limiter maintains and positions a first and a second end of the venting conduit at predetermined locations to provide venting of the transfer conduit to the reservoir portion.

20 Claims, 5 Drawing Sheets

AIR VENTING ARRANGEMENT

CROSS-REFERENCED TO RELATED APPLICATIONS

This application claims benefit of U.S. Provisional Application No. 61/163,962 filed Mar. 27, 2009.

TECHNICAL FIELD

This disclosure relates generally to an air venting arrangement associated with a liquid cooling system, and more particularly to an arrangement and method for venting entrapped air from a flange portion of a shunt vessel configured to transfer coolant from the flange potion of the shunt vessel to the liquid cooling system.

BACKGROUND

Liquid cooling systems typically have a radiator and a shunt vessel connected to the radiator for providing an additional coolant reservoir and/or expansion space as the temperature of the coolant is heated under operation of, for example, an internal combustion engine. Such shunt vessels may also include a reservoir accessible through a sealable opening in the shunt vessel having a removable cap. Coolant may be added to the liquid cooling system by removing the cap and adding coolant. In liquid cooling systems, such as described, during the process of adding coolant to the liquid cooling system, an air pocket may form in a transfer conduit connecting the shunt vessel to the radiator, which may restrict the adding of additional coolant. As a result, the air pocket in the transfer conduit may inhibit the filling of the liquid cooling system to the desired level. At least, such an air pocket may increase the filling time of the liquid cooling system. Such difficulty may cause incomplete filling which may result in inadequate cooling of the internal combustion engine and other systems requiring cooling.

Additionally, shunt vessels may be constructed of a non-metallic material. Such shunt vessels may have a flange portion through which coolant passes to the liquid cooling system. Often a flexible non-metallic transfer conduit, for example, a rubber reinforced hose, may be connected by a clamp to the flange portion and connected by a clamp to the liquid cooling system. The flange portion may be deformable under clamping forces related to the connection of the non-metallic transfer conduit to the flange portion. This connection may be prone to leakage and, in extreme conditions, failure of the flange portion because of deformation.

U.S. Pat. No. 7,261,069, dated Aug. 28, 2007, to Alfred A. Gunther, discloses an active de-aeration system for automotive coolant systems. A coolant fill tube is connected to the head/block of an internal combustion engine and has a de-aeration baffle connected to a vent tube disposed within the fill tube. Such a de-aeration system is suitable for venting air from the head/block. However, such a de-aeration system is not capable of venting air from a transfer conduit connected between the fill tube and the liquid cooling system.

The present disclosure is directed to overcoming one or more of the deficiencies set forth above.

SUMMARY

In one aspect of the present disclosure, an arrangement for venting air from a liquid cooling system of an internal combustion engine is provided. A shunt vessel has a reservoir portion and a flange portion. The flange portion has a passage and is adapted to pass a coolant from the reservoir portion through the passage. A transfer conduit connects the flange portion to the liquid cooling system. The transfer conduit is configured to transfer the coolant from the passage of the reservoir portion of the shunt vessel to the liquid cooling system. A venting conduit is disposed in the passage, and is connected to the flange portion. The venting conduit has first and second spaced ends, and is open at the first end to the reservoir portion, and at the second end to the transfer conduit. The first end is positioned at a predetermined location relative to the reservoir portion, and the second end is positioned at a predetermined location relative to the transfer conduit. The predetermined locations of the first and second ends enables the venting of air entrained in the transfer conduit to the reservoir portion, and the flow of coolant from the reservoir portion through the passage and through at least a portion of the transfer conduit.

In another aspect of the present disclosure, a method for enabling a rapid filling of a liquid cooling system of an internal combustion engine with a coolant by way of a shunt vessel connected to the cooling system by a transfer conduit is provided. The method includes passing the coolant through a transfer conduit from the shunt vessel to the cooling system, and venting air from a predetermined location within the transfer conduit to a predetermined location within a reservoir portion of the shunt vessel through a venting conduit disposed within a passage of a flange of the shunt vessel.

In yet another aspect, the present disclosure describes a venting arrangement for a shunt vessel. The shunt vessel defines a reservoir portion having an opening for fluid connection to an engine cooling system. The venting arrangement includes a compression limiter connected to the shunt vessel and forming a bore that defines the opening at an end thereof. The bore is open to the reservoir portion at its other end. A standpipe fluidly connects the opening with the reservoir portion, such that the standpipe extends above a fill level of coolant within the reservoir portion. In one embodiment, the standpipe is defined as a portion of a tubular venting conduit, which forms an inlet pipe disposed within the bore and is connected to the standpipe by an elbow.

DETAILED DESCRIPTION

Figure 1:
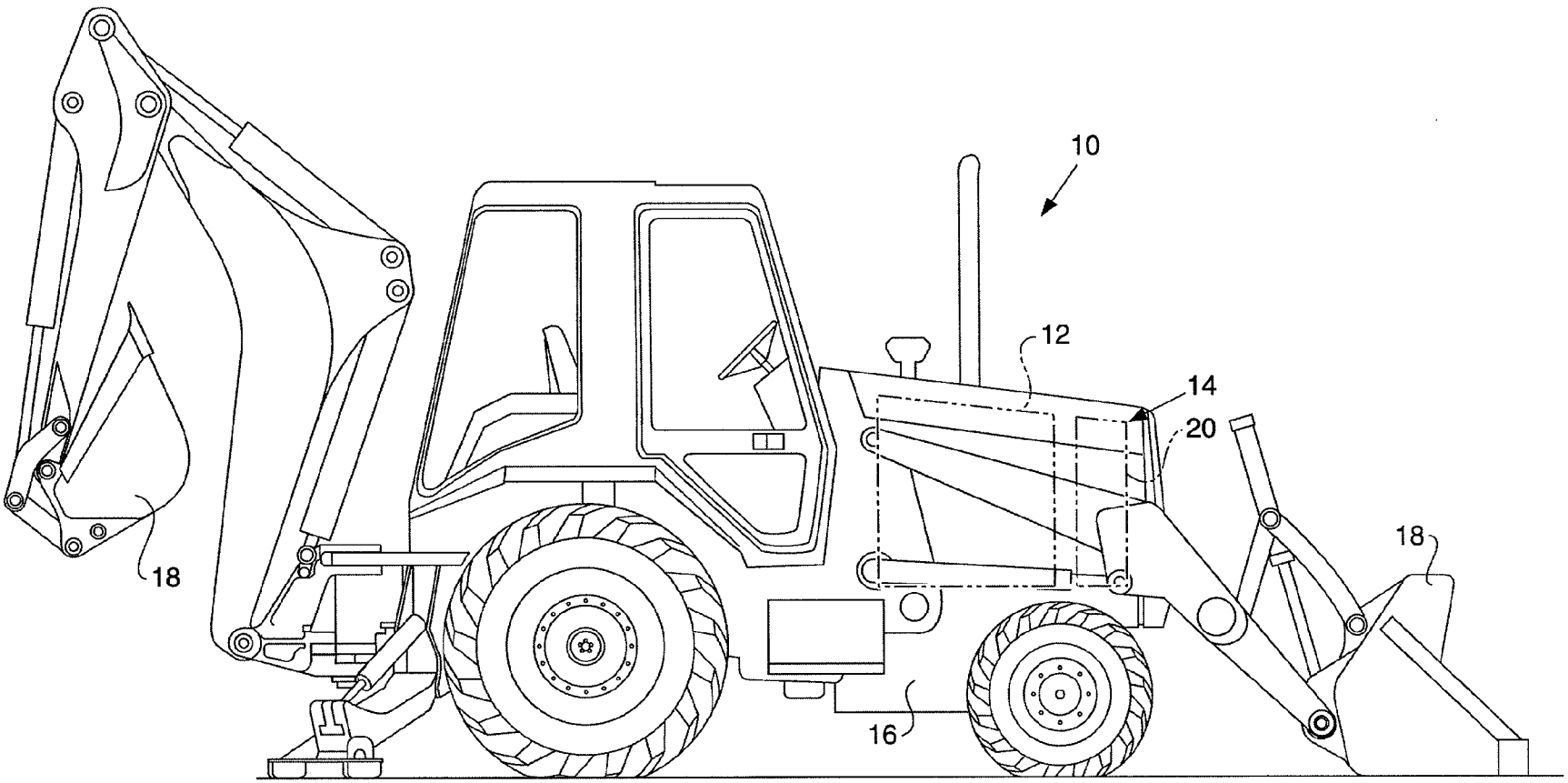
FIG. 1 is a diagrammatic elevational view of an earth working machine associated with the air venting arrangement of the present disclosure.

With reference to the drawings and particularly FIG. 1, a machine 10, for example, a backhoe loader is shown. Any machine 10 having an internal combustion engine 12, and a cooling system 14 is within the scope of this disclosure. The machine 10 has a frame 16, and work implements 18 operatively connected to the frame 16. The internal combustion engine 12 and the cooling system 14 are connected to the frame 16. The cooling system 14 is adapted to cool a coolant circulated through the internal combustion engine 12, and maintain a predetermined operating temperature range within the engine 12. The cooling system 14 may also cool other machine systems (not shown), such as, an implement hydraulic system, a machine transmission, a turbocharger aftercooler/intercooler, an exhaust gas recirculation system, and other machine systems requiring a liquid coolant.

Figure 2:
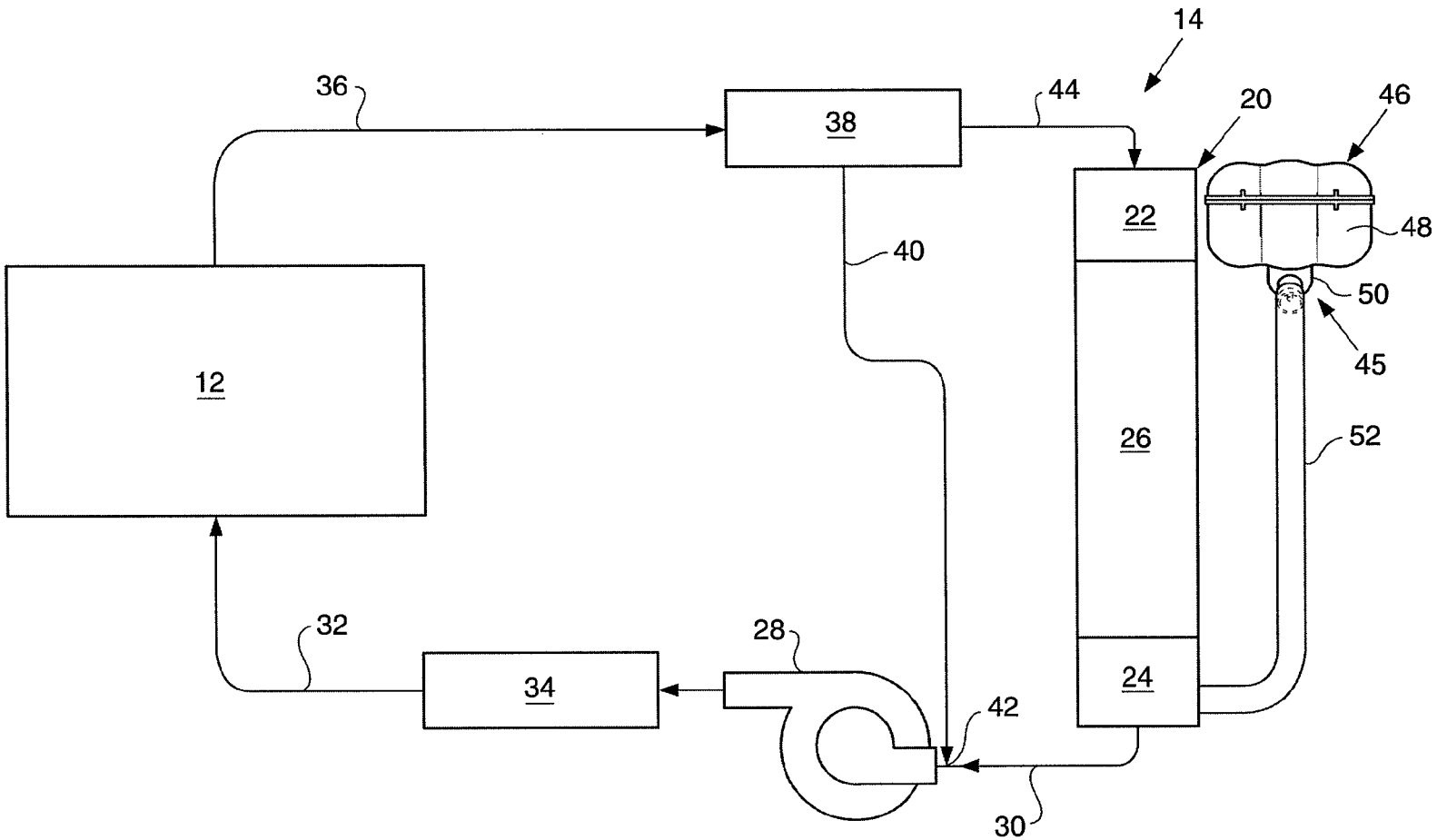
FIG. 2 is a diagrammatic schematic of a liquid cooling system employing the air venting system of the present disclosure.

With reference to FIG. 2, the liquid cooling system 14 has a radiator 20 having upper and lower tanks 22, 24, and a cooling core 26 of conventional construction connected between the upper and lower tanks 22, 24. The cooling core 26 is adapted to cool the coolant passed between the upper and lower tanks 22, 24. A cooling fan (not shown) is provided to pass cooling air through the core and reduce, by convection, the temperature of the coolant flowing between the upper and lower tanks 22, 24.

A pump 28 is connected to the lower tank 24 of the radiator 20 by conduit 30 and to the internal combustion engine 12 by conduit 32. The conduit 32 circulates coolant from the pump 28 to the internal combustion engine. An engine lubrication oil cooler 34 may be provided in the conduit 32 to utilize coolant delivered by the pump 28 to the internal combustion engine 12 to cool the lubrication oil of the internal combustion engine. The coolant passed by conduit 32 is provided to cool the block, cylinder head, and other components (all not shown) of the internal combustion engine 12 in a conventional manner. Heated coolant exits the internal combustion engine by conduit 36 which is connected at a predetermined location of the internal combustion engine 12, the cylinder head, or cylinder block. Conduit 36 is connected to a thermostat 38. The thermostat is connected by conduit 40 to an inlet 42 of pump 28 and by conduit 44 to the upper tank 22. The direction of the flow of coolant in conduit 36 is controlled by thermostat 38. The temperature of the coolant in conduit 36 will determine the response of the thermostat and the direction of flow of the coolant. Should the temperature of the coolant be below a predetermined temperature, coolant will be directed by the thermostat 38 to conduit 40 bypassing the radiator 20. At temperatures above the predetermined temperature, coolant will be passed by conduit 44 to the upper tank of the radiator 20.

An arrangement 45 is provided for venting air from the liquid cooling system 14. The arrangement 45 includes a shunt vessel 46 having a reservoir portion 48, and a flange portion 50. The flange portion 50 is connected by a transfer conduit 52 to the liquid cooling system 14. In particular, the transfer conduit 52 may be connected to the lower tank 24 of the radiator 12 and adapted to transfer coolant from the reservoir portion 48 to the liquid cooling system 14. The shunt vessel 46, the reservoir portion 48, and the flange portion 50 may be constructed of a non-metallic material, for example, a plastic of any suitable composition capable of supporting the coolant therein. The shunt vessel 46 is connected to one of the machine 10, and radiator 20, and maintained at a predetermined elevational location relative to the radiator 20 in order to provide proper operation and flow of the coolant between the liquid cooling system 14 and the radiator 20.

Figure 3:
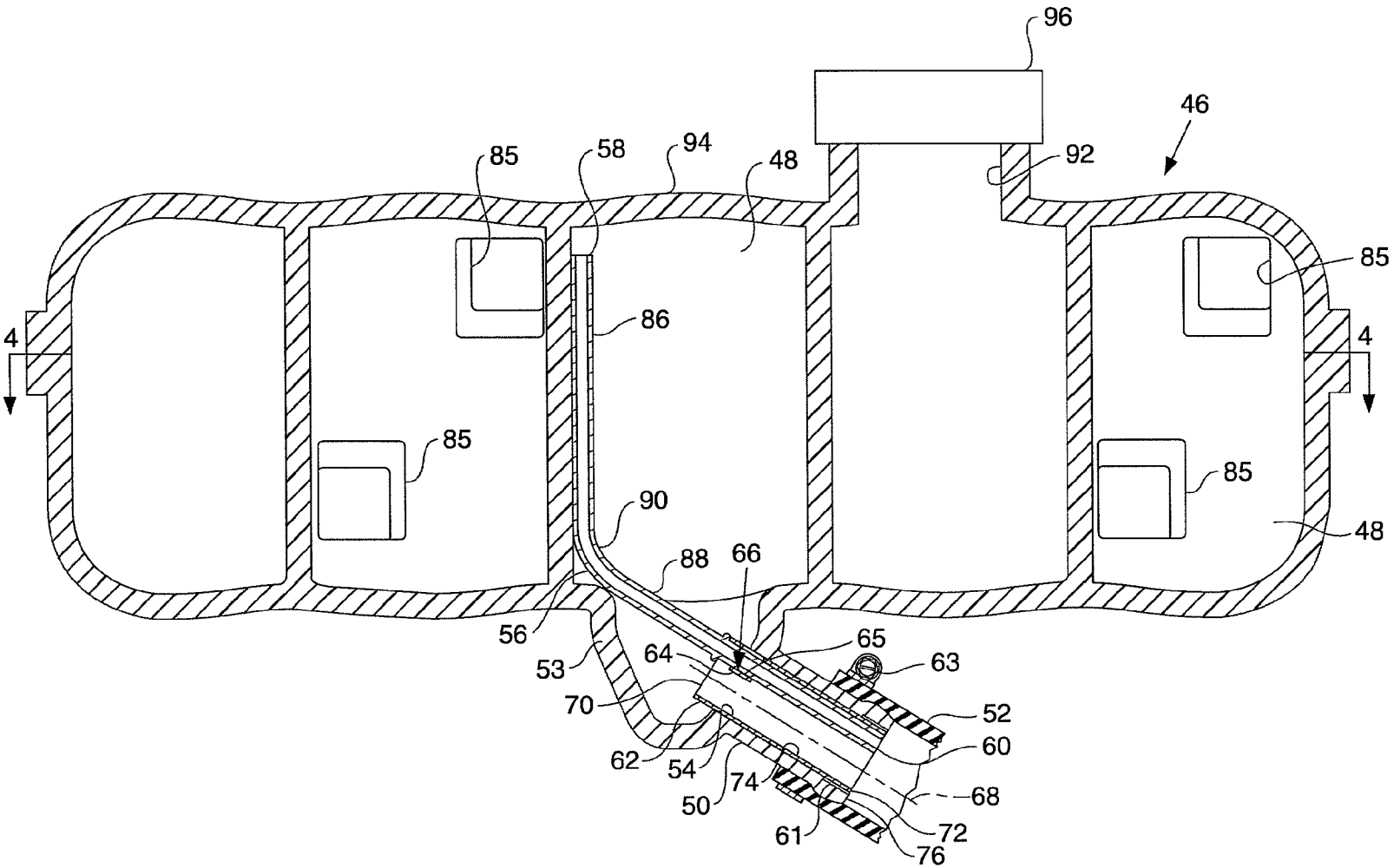
FIG. 3 is a diagrammatic cross-sectional view of a shunt vessel in accordance with the present disclosure.
Figure 4:
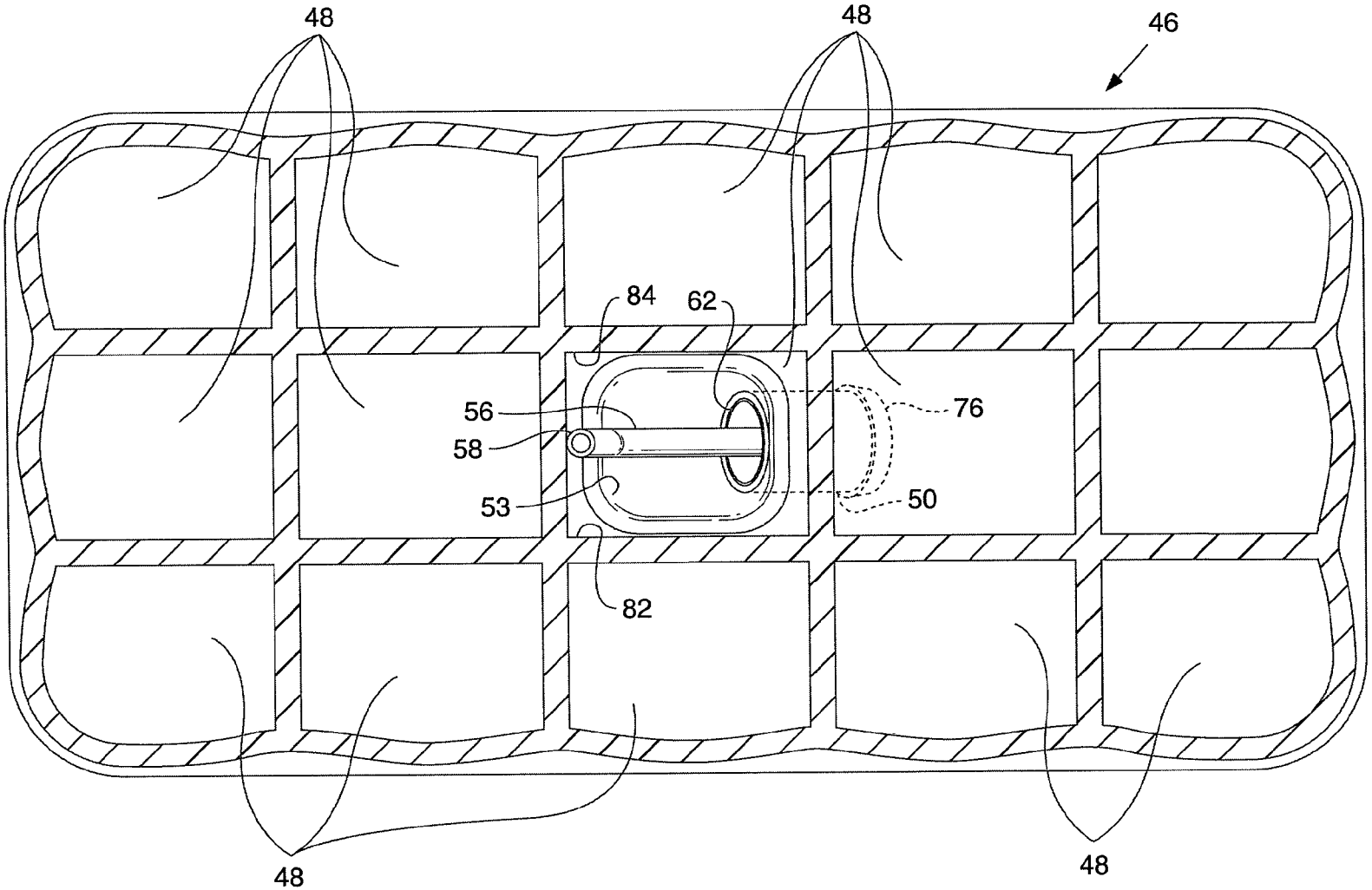
FIG. 4 is a diagrammatic cross-sectional view taken along lines 4-4 of FIG. 3.

As best shown in FIG. 3, the flange portion 50 has a reservoir connection portion 53, and a passage 54. A venting conduit 56 is disposed in the passage 54, and is connected to the flange portion 50. The venting conduit 56 has first and second spaced apart ends 58, 60, and is open at the first end 58 to the reservoir, and open at the second end 60 to the transfer conduit 52. The first end 58 of the venting conduit 56, which also can be referred to as a standpipe, is positioned at a predetermined elevational location relative to and within the reservoir portion 48. The second end 60 is positioned at a predetermined location relative to the transfer conduit 52. The predetermined locations of the first and second ends 58, 60 may enable a venting of air entrained in the transfer conduit 52 to the reservoir portion 48, and may enable a flow of coolant from the reservoir portion 48 through the passage 54, and through at least a portion of the transfer conduit 52.

Figure 5:
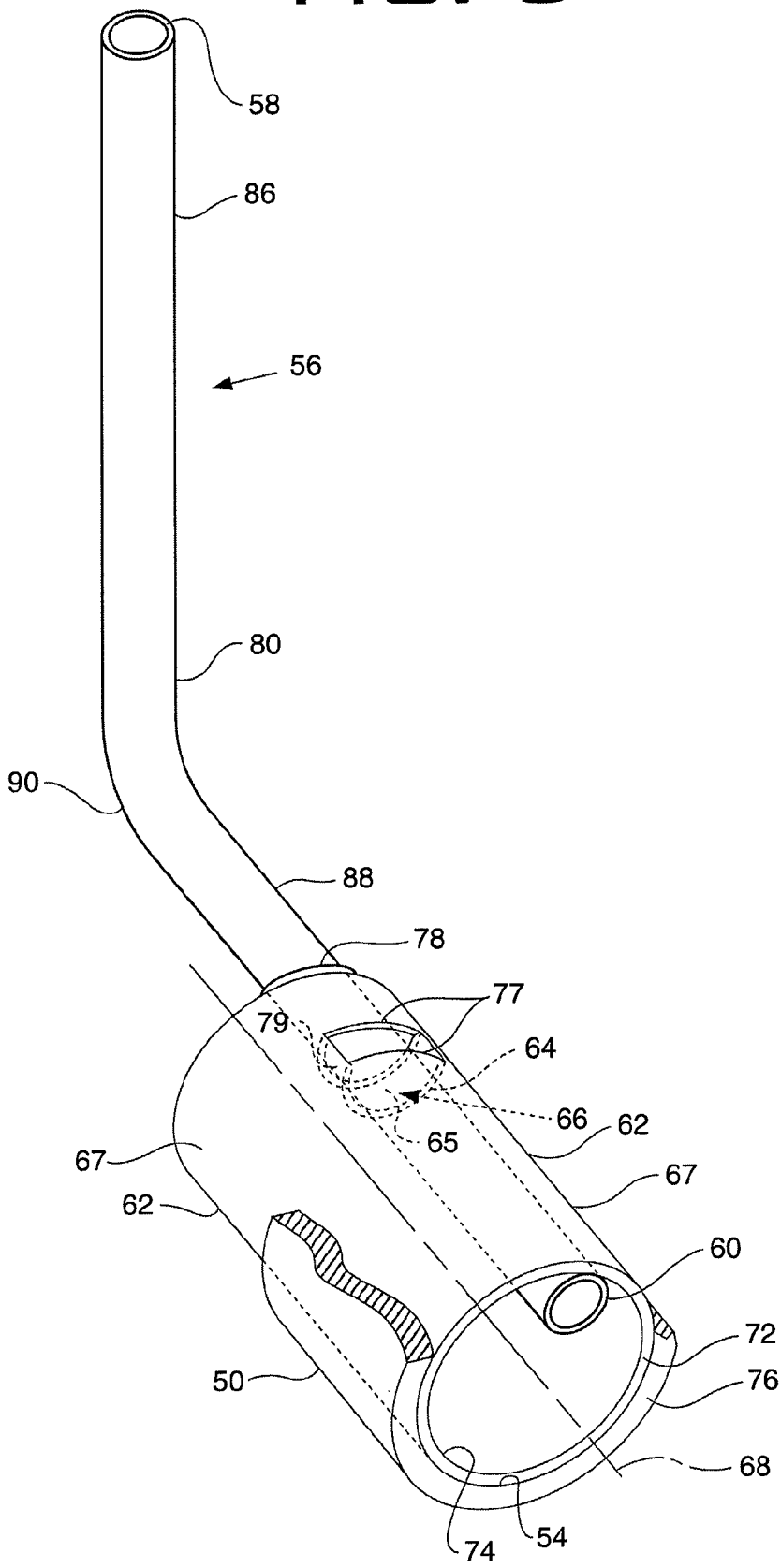
FIG. 5 is a diagrammatic isometric view showing a portion of the flange portion, a compression limiter, a venting conduit, and a fastener connecting the venting conduit to the crush limiter.

As best seen in FIGS. 3 and 5, a compression limiter 62 is disposed in the passage 54 of the flange portion 50 and maintains the flange portion 50 from deformation under external loading. Such deformation may occur, for example, under the compression of a hose clamp 63 clampingly connecting the flange portion of the transfer conduit 52, which may be a flexible hose, to the flange portion 50, at a location about the flange portion reinforced by the compression limiter 62. A fastener 64 connects the venting conduit 56 to the compression limiter 62, and maintains the venting conduit 56 from movement relative to the compression limiter 62. It is to be noted that multiple fasteners may be provided. Should multiple fasteners be used they should be aligned with one another in an axial direction. In particular, the fastener 64 and the compression limiter 62 define a fastener opening 66 through which the venting conduit 56 is disposed. The venting conduit 56 may be forcibly retained from movement relative to the compression limiter 62, such as by an interference fit between the venting conduit 56, the fastener 64, and a surface 65 defining the fastener opening 66. The compression limiter 62 may be a cylindrical sleeve 67 having a longitudinal axis 68, first and second spaced apart ends 70, 72, an outer surface 61, and a bore 74. The compression limiter 62 may be forcibly engaged with the flange portion 50, and maintained from movement relative to the flange portion 50 by such forcible engagement. Specifically, the outer surface 61 of the compression limiter 62 is forcibly engaged with the passage 54 of the flange portion 50.

The fastener 64 may be formed from a portion of the compression limiter 62 at a predetermined axial location between first and second spaced apart ends 70, 72 of the compression limiter 62. A pair of spaced apart substantially parallel cuts 77 may be made in the compression limiter 62 in a direction transversely relative to the axis 68. A portion 79 of the compression limiter 62, between the cuts 77, is deformed inwardly into the bore 74 of the compression limiter 62 to provide a surface 65 of the fastener which along with the bore 74 defines the compression limiter opening 66. In an alternate embodiment, the fastener 64 may be a separate member connected within the bore 74 to the compression limiter 62.

The predetermined axial location of the fastener 64 is at an elevation ally highest position within the bore 74 of the compression limiter 62. The predetermined axial location is closest to the first end 70 of the venting conduit 56 in order to provide maximum rigidity and static position control. The radial location within the bore 74, and the passage 54, is substantially at a 12 o'clock position.

The flange portion has a reservoir connection portion 53, and an end 76. The passage 54 is open at the end 76 and at the reservoir connection portion 53. The second end 72 of the compression limiter 62 is located adjacent an end 76 of the flange portion 50 and within the passage 54 of the flange portion 50. In one embodiment, the second end 72 may be flush with, slightly within, or beyond the end 76 of the flange portion. The second end 60 of the venting conduit 56 may be substantially flush with and protected by an end 76 of the flange portion 50.

The venting conduit 56, which is tubular and may be made of a non-metallic material, such as plastic material, may have a stop 78 located on a periphery 80 between the first and second ends 58, 60. The stop 78, as shown, is an annular ring 82 molded on the periphery 80 of the venting conduit 56. However, other stop configurations such as, abutments, projections, beads, and other localized shapes are considered equivalents. The stop 78 may be engageable with the first end 70 of the compression limiter 62 and establishes the axial location of the first and second ends 58, 60 of the venting conduit 56 relative to the compression limiter 62. It is to be noted that the stop 78 determines the location of the second end 60 of the venting conduit 56 relative to the second end 72 of the compression limiter 62. As previously mentioned, since the position of the second end 72 of the compression limiter 62 is maintained relative to the end 72 of the flange portion, the precise position of the venting conduit 56 and proper venting of the transfer conduit 52 may be achieved.

The shunt vessel 46 has at least a first wall 82 and a second wall 84. The first and second walls 82 and 84 are spaced apart from one another and provide rigidity to the shunt vessel 46. The walls 82, 84 define separated areas of the reservoir portion 48, and may have openings to allow cooling fluid flow and other fluids to pass between the first and second walls 82, 84. Additional walls may be provided to increase rigidity and to maintain the shunt vessel from undesirable expansion and/or contraction under fluctuating pressure conditions. The walls 82, 84 and additional walls may have openings 85 to enable the passing of coolant between walls 82, 84 and any additional walls. The first and second walls 82, 84 are spaced apart by a predetermined distance to provide a back up tipping stop for the venting conduit 56. In particular, the venting conduit 56 has a first straight end portion 86, a second straight end portion 88, and a curved intermediate portion 90 joining the first and second straight end portions 86,88. The first straight end portion 86 is disposed in the reservoir portion 48 of the shunt vessel 48 between the first and second walls 86, 88. The first and second walls 86, 88 are positioned to prevent excessive tipping movement of the venting conduit 56, and particularly that of the first end portion 88, in order to ensure that air is vented from the transfer conduit 52 during filling of the shunt vessel 46.

The shunt vessel 46 has an opening 92 disposed in a top portion 94 of the shunt vessel 46 and a cap 96 releasably connected to the top portion and operatively positioned to seal the opening 92. The cap 96 maintains pressure in the shunt vessel 48 during operation at a predetermined maximum pressure of, for example, about 1 bar, and opens to relieve pressure in excess of the predetermined maximum pressure.

INDUSTRIAL APPLICABILITY

The present disclosure is applicable to an arrangement 45 for venting air from the transfer conduit 52 connected between the reservoir portion 48 of the shunt vessel 46 and the liquid cooling system 14 of the internal combustion engine 12, of the machine 10, by way of the venting conduit 56 disposed internally in the passage 54 of the flange portion 50 of the shunt vessel 46. In particular, during filing, and adding of additional coolant to the liquid cooling system 14, the predetermined locations of the venting conduit 56 within the reservoir portion 48, and within the transfer conduit 52 facilitates the transfer of coolant through the transfer conduit 52 from the shunt vessel 46 to the liquid cooling system 14 by passing air from the transfer conduit 52 to the reservoir portion 48. The predetermined locations of the first and second ends were been determined empirically and through experimentation. The predetermined locations of the first and second ends 58, 60 of the venting conduit 56 are, respectively, open above the coolant level in the reservoir portion 48 of the shunt vessel 46, and at the predetermined location within the transfer conduit 52 at which pockets of air may form.

A filling of the liquid cooling system 14 with coolant is achieved by removing the cap 96 from the shunt vessel 46, and adding coolant through the opening 92 at the top portion 94 of the shunt vessel 46 normally closed by the cap 96. The coolant being added to fill the liquid cooling system 14 passes through the passage 54 in the flange portion 50, through the transfer conduit 52 which is connected to the flange portion 50 of the shunt vessel 46, and to the liquid cooling system 14, and in particular to the radiator 20. Positioning of the second end 60 of the venting conduit 56 permits air trapped in the transfer conduit 52 to vent into the reservoir portion 48, which facilitates a free flow of the coolant being added to the liquid cooling system 14.

The compression limiter 62 and fastener 64 maintains the orientation of the venting conduit 56, and the first and second ends 58, 60 of the venting conduit 56, at predetermined locations to ensure that the venting conduit 56 provides the desired venting of air from the transfer conduit 52. Since the fastener 64 may be formed from a portion of the compression limiter 62 additional parts and assembly have been eliminated while the desired venting conduit 56 position and retention are provided. If the first end 58 of the venting conduit 56 tends to move from the predetermined location, the first and second walls 82, 84 of the shunt vessel will maintain the first straight end portion 86 of the venting conduit 56 in an upright position, and the first end 58 at an acceptable location within the reservoir portion 48 at which venting is available. As a result, venting during the addition of coolant will be maintained.

The method for enabling a rapid filling of the liquid cooling system 14 of an internal combustion engine 12 with a coolant by way of a shunt vessel 46 connected to the cooling system by the transfer conduit 52 includes passing coolant through the transfer conduit 52 from the shunt vessel to the liquid cooling system 14, and venting air from the predetermined location within the reservoir portion 48 of the shunt vessel 46 through the venting conduit 56 disposed within the passage 54 of the flange portion 50 of the shunt vessel 46 during the passing of the coolant from the shunt vessel 46 to the liquid cooling system 14.

The method may also include maintaining of the venting conduit 56 at the predetermined location relative to the reservoir portion 48 of the shunt vessel 46 and at the predetermined location relative to the transfer conduit 52 so that a first end 58 of the venting conduit 56 and the second end 60 of the of the venting conduit 56 may be open to vent air from the transfer conduit 52 to the portion 48 during a filling of the liquid cooling system 14.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

All methods described herein can be performed in any suitable order unless otherwise indicated herein or otherwise clearly contradicted by context.

Accordingly, this disclosure includes all modifications and equivalents of the subject matter recited in the claims and appended hereto as permitted by applicable law. Moreover, any combination of the above-described elements in all possible variations thereof is encompassed by the disclosure unless otherwise indicated herein or otherwise clearly contradicted by content.

We claim:

1. An arrangement for venting air from a liquid cooling system of an internal combustion engine, comprising:

a shunt vessel having a reservoir portion and a flange portion, said flange portion having a passage in fluid communication with the reservoir portion;

a transfer conduit fluidly connecting the flange portion with the liquid cooling system, said transfer conduit arranged to transfer coolant between the reservoir portion and the liquid cooling system;

a venting conduit disposed in the passage and connected to the flange portion, said venting conduit having first and second spaced ends, wherein the first end is open to the reservoir portion and the second end is open to the transfer conduit, said first end being positioned at a predetermined location relative to the reservoir portion, said second end being positioned at a predetermined location relative to the transfer conduit, said predetermined locations of the first and second ends adapted to vent air trapped in the transfer conduit to the reservoir portion.

2. The arrangement, as set forth in claim 1, including:

a compression limiter disposed in the passage; and at least one fastener connecting the venting conduit to the compression limiter and maintaining the venting conduit from movement relative to the compression limiter.

3. The arrangement, as set forth in claim 2, wherein the venting conduit is disposed through a fastener opening defined between said fastener and the compression limiter.

4. The arrangement, as set forth in claim 3, wherein the compression limiter is a substantially cylindrical tube having a longitudinal axis and first and second spaced apart ends, wherein said compression limiter is engaged to the flange portion and maintained from movement relative to the flange portion, and wherein said fastener is at least partially formed by a portion of the compression limiter at a predetermined location axially between the first and second ends thereof.

5. The arrangement, as set forth in claim 3, wherein the compression limiter forms a bore, and wherein said predetermined axial location of the fastener is at an elevationally high position relative to the bore of said compression limiter.

6. The arrangement, as set forth in claim 2, wherein said shunt vessel, the reservoir portion, and the flange portion, are made from a non-metallic material.

7. The arrangement, as set forth in claim 1, wherein the predetermined location of the second end of the venting conduit is located adjacent an end of the flange portion within the passage.

8. The arrangement, as set forth in claim 7, wherein the second end of the venting conduit is substantially flush with the end of the flange portion.

9. The arrangement, as set forth in claim 7, including:

a compression limiter disposed in an aperture of the flange portion; and a least one fastener connecting the venting conduit to the compression limiter and maintaining the venting conduit from movement relative to the compression limiter;

wherein said compression limiter defines first and second spaced ends, and wherein the second end is adjacent the end of the flange portion.

10. The arrangement, as set forth in claim 9, wherein the second end of the compression limiter is substantially flush with the end of the flange portion.

11. The arrangement, as set forth in claim 9, wherein said compression limiter is tubular and forms a bore, wherein said venting conduit is disposed in the bore and wherein the at least one fastener formed by a portion of the compression limiter and adapted to maintain the venting conduit from movement relative to the compression limiter.

12. The arrangement, as set forth in claim 2, including:

a stop formed on the periphery of the venting conduit;

wherein said compression limiter defines a first end, and wherein the stop engages the first end of said compression limiter and locates said venting conduit axially relative to said compression limiter.

13. The arrangement, as set forth in claim 12, wherein said compression limiter defines a second end axially spaced at a preselected distance from the first end of the compression limiter, wherein the venting conduit defines a second end, and wherein said stop determines the position of the second end of the venting conduit relative to the second end of the compression limiter.

14. The arrangement, as set forth in claim 12, wherein said stop includes one of a bead, a protrusion, and a ring.

15. The arrangement, as set forth in claim 2, wherein said shunt vessel forms first and second internal spaced apart walls, wherein said venting conduit defines first and second substantially straight end portions and a curved intermediate portion disposed between the first and second substantially straight end portions, wherein said first straight end portion is disposed between said first and second spaced apart walls, wherein said second end portion is disposed in the passage of said flange, and wherein said first and second walls are arranged to prevent tipping of the first end portion of the venting conduit relative to said reservoir portion.

16. The arrangement, as set forth in claim 2, wherein said transfer conduit is a flexible hose clampingly connected to the compression limiter.

17. A method for filling a cooling system of an internal combustion engine with coolant through an opening formed in a shunt vessel connected to the liquid cooling system by a transfer conduit, comprising:

passing coolant through the transfer conduit; and venting air from a predetermined location within the transfer conduit to a predetermined location within a reservoir portion of the shunt vessel via a venting conduit disposed between the shunt vessel and the transfer conduit.

18. The method of claim 17, including maintaining the venting conduit at the predetermined location relative to the shunt vessel and the transfer conduit such that a first end of the venting conduit and a second spaced end of the venting conduit are open to vent air from the transfer conduit to the reservoir portion during said filling of the liquid cooling system.

19. A venting arrangement for a shunt vessel defining a reservoir portion and having an opening adapted to fluidly connect the reservoir portion with an engine cooling system, comprising:

a compression limiter forming a bore defining the opening at an end thereof and being open to the reservoir portion at another end thereof;

a standpipe fluidly connecting the opening with the reservoir portion;

wherein the standpipe is adapted to extend above a fill level of coolant disposed within the reservoir portion.

20. The venting arrangement of claim 19, wherein the standpipe is defined as a portion of a tubular venting conduit, which forms an inlet pipe disposed within the bore and connected to the standpipe by an elbow.

* * * * *